US005148632A

United States Patent [19]

Adler et al.

[11] Patent Number: 5,148,632

[45] Date of Patent: Sep. 22, 1992

[54] CAVITY FORMING IN PLASTIC BODY

[75] Inventors: Meryle D. W. Adler, Corning; John W. Nelson, Painted Post; Harold G. Shafer, Jr., Rock Stream, all of N.Y.

[73] Assignee: Corning Incorporated, Corning, N.Y.

[21] Appl. No.: 715,571

[22] Filed: Jun. 14, 1991

[51] Int. Cl.[5] ..... B24B 13/00

[52] U.S. Cl. ..... 51/55; 51/124 L; 51/125; 51/284 R

[58] Field of Search ..... 51/124 L, 109 R, 125, 51/125.5, 168, 134.5 R, 134.5 F, 55

[56] References Cited

U.S. PATENT DOCUMENTS

| | | | |
|---|---|---|---|
| 1,171,174 | 2/1916 | Corry | 51/55 |
| 1,659,277 | 2/1928 | Maynard | 51/124 L |
| 1,671,027 | 5/1928 | George | 51/124 L |
| 1,681,249 | 8/1928 | Mulholland | 51/134.5 R |
| 1,871,123 | 8/1932 | Laabs | 51/55 |
| 2,087,687 | 7/1937 | Houchin | 51/124 L |
| 2,975,565 | 3/1961 | Phillips | 51/124 L |
| 4,852,436 | 8/1989 | Benjamin | 82/19 |
| 4,869,626 | 9/1989 | Kosmowski | 409/231 |
| 4,974,368 | 12/1990 | Miyamoto et al. | 51/55 |

*Primary Examiner*—Bruce M. Kisliuk
*Assistant Examiner*—Bryan Reichenbach
*Attorney, Agent, or Firm*—Milton M. Peterson; Clinton S. Janes, Jr.

[57] ABSTRACT

An apparatus and method for forming a cavity in a rigid, organic plastic body comprises an abrading tool mounted on a carrier, an air spindle for imparting a rotary motion to the tool, and a second air spindle on which the tool carrier is mounted and which has a force applied to it to move the tool through an arc that passes through the plastic body.

7 Claims, 4 Drawing Sheets

CAVITY FORMING IN PLASTIC BODY

FIELD OF THE INVENTION

The field is method and apparatus for forming a cavity in an organic plastic body. In one particular embodiment, the body is an organic plastic lens blank for a multifocal lens, either all-plastic, or as a member of a glass-plastic, laminated lens.

BACKGROUND OF THE INVENTION

The present invention is concerned with producing a cavity in the surface of an organic plastic body. It is particularly concerned with producing such a cavity having an optical quality finish.

The invention arose in connection with providing a segment member in an organic plastic, ophthalmic, multifocal lens. More particularly, the lens was the organic plastic lens for a glass-plastic, laminated, multifocal lens blank. Accordingly, the invention is primarily described with reference to producing such an article, but its broader application will be readily apparent.

A three-layer, composite lens structure is disclosed in U.S. Pat. No. 4,793,703 (Fretz, Jr.); also in pending application Ser. No. 07/325,880, filed Mar. 20, 1989 in the name of E. R. Fretz, Jr. and assigned to the assignee of this application. This lens structure is composed of an inorganic glass layer, a layer of a rigid, organic plastic and an interlayer of a flexible, organic adhesive. These disclosures are primarily concerned with single vision lenses, that is, lenses that provide one type of visual correction.

A copending application, Ser. No. 07/682,479, filed Apr. 8, 1991 in the name of David Dasher et al., entitled HIGH INDEX, ORGANIC LENS MEMBER and assigned to the assignee of this application, is concerned with a multifocal lens structure. This is a four-component, glass-plastic, laminated structure exhibiting optical quality transmission. A characteristic feature of this lens structure is an organic plastic segment embedded in the front, convex surface of the major, organic plastic lens of the structure. The segment has a higher refractive index than the major element.

PURPOSES OF THE INVENTION

In the course of developing the structure of the above copending application, it became desirable to embed a segment member in the front, convex surface of the major, organic plastic lens member. Various options were available to accomplish this. However, the option deemed most acceptable involved forming a cavity in the surface of the plastic lens. That cavity could then be filled with a plastic monomer, and the monomer cured to provide a material having the required refractive lens for a segment.

A basic purpose of our invention is to provide a method and apparatus for forming a cavity in the surface of a plastic body.

A further purpose is to provide such a cavity in a lens that exhibits an optical quality without further finishing after forming.

Another purpose is to provide a cavity in a major, organic plastic lens that may be filled with a monomer that may be cured and finished to provide an organic plastic lens for a laminated, multifocal lens.

A still further purpose is to provide an apparatus that may be easily adjusted to produce cavities of varied shapes in organic plastic bodies.

SUMMARY OF THE INVENTION

To these and other apparent ends, our invention resides in an apparatus for, and method of, forming a cavity in a rigid, organic plastic body.

The apparatus is a milling machine type comprising an abrading tool mounted on a carrier, and means for driving the tool while it is moved through an arc. The abrading tool may be tipped with a hard grinding material, such as diamond or cubic boron nitride (CBN). The carrier may be a motor driven air spindle that may be swung through an arc by an arm mounted on a high precision air bearing. Motion may be imparted to the air bearing through a cable subject to a constant force that is resisted by an opposing force of lesser load, such as a dead weight, or other rotational means, to maintain the cable taut.

The milling machine may further comprise an adjustably mounted holder for the rigid, organic plastic. The holder may be set in a plurality of fixed positions whereby the abrading tool may form cavities having selected radii of curvature. One such cavity may correspond to the segment shape known as a "D-seg" in a bifocal lens.

The method comprises removing material from the surface of a rigid, organic plastic body to form a cavity of a predetermined size and shape in a predetermined zone in the body. The cavity may be formed by progressive milling, preferably by a single pass of an abrading tool. The abrading tool may be tipped with diamond or cubic boron nitride, and may form a surface that needs no further finishing. The lens may be so held with respect to the abrading tool that the cavity corresponds to a selected segment shape, such as a D-seg in a bifocal lens.

PRIOR ART

In addition to the Fretz, Jr. disclosures mentioned earlier, the following U.S. patents are noted:

U.S. Pat. No. 4,406,189 (Neefe) discloses a method of making a lenticular contact lens by rotating the lens on a lathe while forming a thin flange on the lens with a cutting tool, U.S. Pat. No. 4,460,275 (Spriggs) discloses a computer-controlled, fluid-bearing, automatic or semi-automatic machine for forming a plurality of optical surfaces on a contact lens blank, U.S. Pat. No. 4,713,913 (Adler) discloses a machine embodying air slides to precisely position a spherical grinding tool used in forming a cavity in an optical lens mold, and U.S. Pat. No. 4,854,089 (Morales) disclosed a bifocal contact lens having prisms introduced in the base and vision curves, and a process for producing the lens by lathe cutting.

BRIEF DESCRIPTION OF THE DRAWINGS

In the accompanying drawings.

DESCRIPTION OF THE INVENTION

The present invention provides a convenient, and very effective, means of producing a cavity in the surface of an organic plastic body. A particular feature is the capability of producing a cavity in the nature of a countersink in an organic plastic lens blank that has an optical quality surface without further finishing, such as polishing. The invention is of particular value in performing the indicated optical function, but, obviously, has a wider range of utility.

Figure 1:
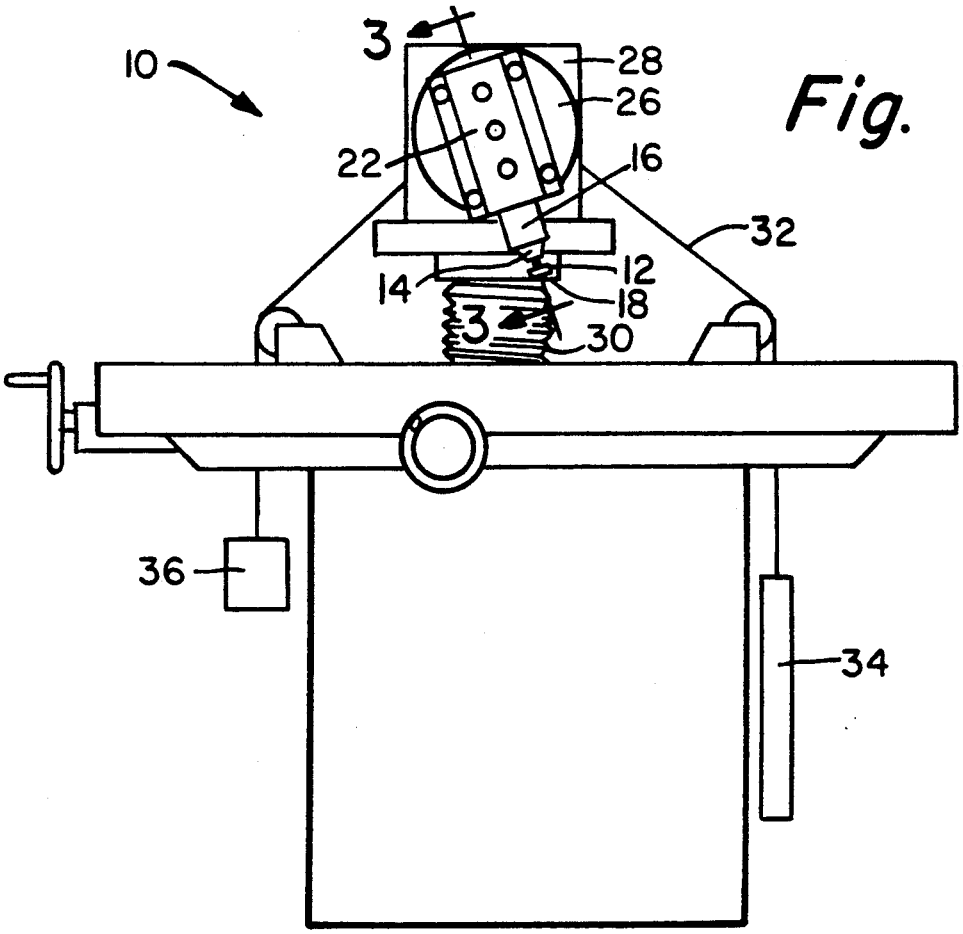
FIG. 1 is a schematic side view showing the apparatus of the invention.

FIG. 1 is a schematic front view of a milling apparatus, generally designated 10. Apparatus 10 is designed to produce a cavity of desired shape and size in a plastic body, such as lens 38 shown in FIGS. 5 and 6.

Figure 3:
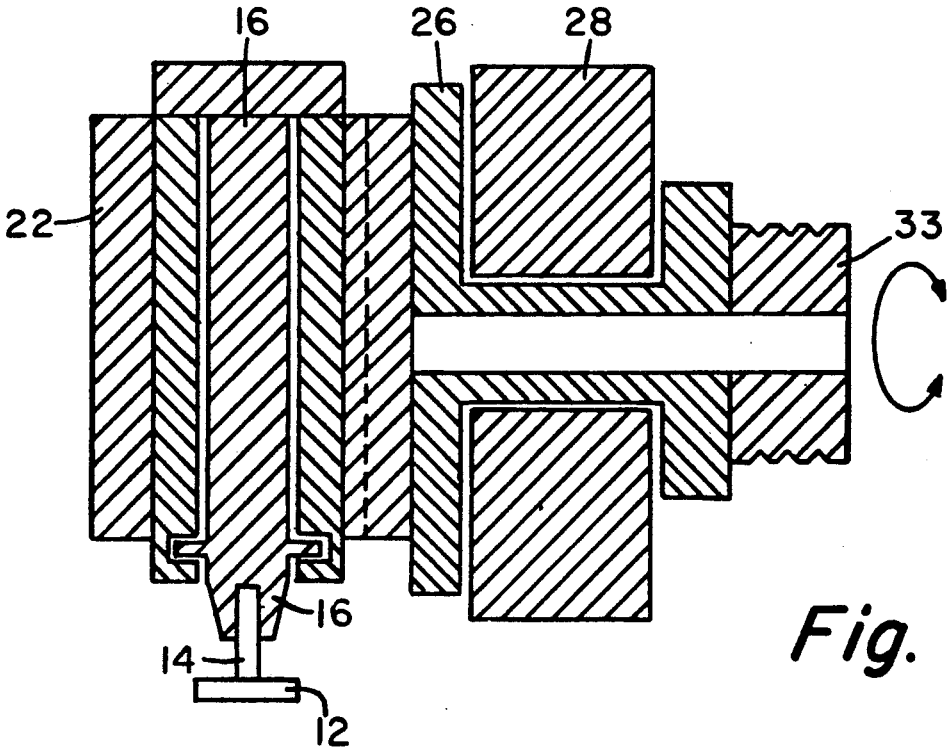
FIG. 3 is a cross-section view taken along line 3—3 in FIG. 1.
Figure 2:
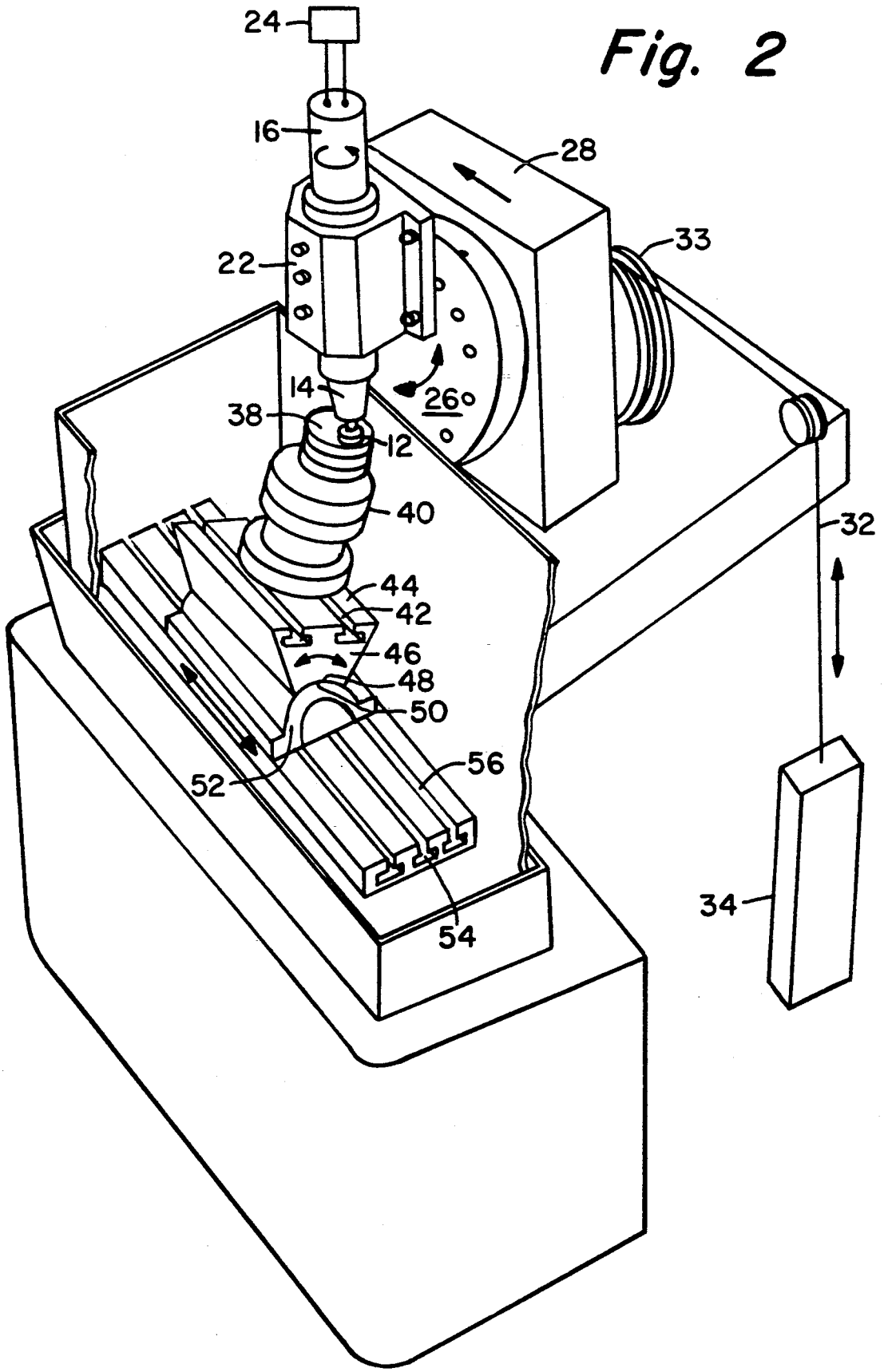
FIG. 2 is a perspective view showing the apparatus of FIG. 1 in operation.

FIG. 2 is a perspective view showing apparatus 10 in an operative state. FIG. 3 is a cross-section view along line 3—3 in FIG. 1 showing the internal structure of apparatus 10.

The operative element in apparatus 10 is a grinding or abrading tool 12 that is locked in a holder 14 which may be an extension of air bearing spindle 16. Tool 12 may take various forms, such as a tubular core drill or a cup wheel. Whatever the form, the outer, working end 18 of tool 12 is tipped with a hard, abrasive material, such as diamond or cubic boron nitride, to provide a quality finish.

Air bearing spindle 16 has a rotating motion imparted to it by a high speed, air turbine or electric motor 24. It is referred to as a Westwind High Speed Air Bearing Spindle, and is commercially available from Federal Mogul Corporation. Spindle 16 is surrounded by mounting bracket 22 which is mounted on air spindle 26. Spindle 26 is available commercially from Professional Instruments, St. Paul, Minn. under the designation Blockhead Air Bearing. It operates within a fixed blockhead 28 that is mounted on a supporting post 30 attached to work table (now shown).

In operation, air spindle 26 has a reversible, rotary motion imparted. The motion is such that attached bracket 22 and spindle 16 are swung through a limited arc. During this movement of spindle 16, it is energized to render abrading tool 12 operative.

The arc, through which spindle 16 and tool 12 are swung, is such that tool 12 moves along a path from a point on one side of a plastic body, such as lens 38, to a point on the opposite side of the body. The path passes through the body whereby a predetermined portion of the body is removed to form a cavity, such as those shown in FIGS. 5 through 10. At completion of the path, the plastic body is removed, and the rotary motion of spindle 26 is reversed to swing spindle 16 and tool 12 back to the starting point of the path.

Movement of air spindle 26 is imparted through a cable 32. Cable 32 is wrapped about a grooved cylinder 33 attached to the end of spindle 26 opposite to the end carrying air bearing spindle 16. The cable is held taut as shown in FIG. 2. Cable 32, and thereby movement of the assembly through its operating arc, is actuated by hydraulic or air pressure means 34. As indicated by the double arrow, this actuating force may be reversed to return the assembly to its starting position. The force applied to cable 32 is resisted by a dead weight 36 that is carried on the opposite end of cable 32, that is of lesser load than 34, and that maintains the cable taut. Alternatively, a second cylinder might be employed, similar to 34, but set at a lower constant load.

To carry out the inventive method, a solid plastic body, shown as a lens blank 38 in FIG. 2, is mounted on a carrier 40. Carrier 40 rides in lateral grooves 42 on the upper surface 44 of block 46. Block 46 has a concave under surface 48 corresponding in reverse to convex surface 50 on block 52. Block 52, in turn, is carried in grooves 54 on table surface 56. The combination of carrier 40, blocks 46 and 52, and grooved surface 56 is a commercial unit available as an adjustable angle plate from Travers Tool Co.

This mounting arrangement permits easy lateral movement along the grooves. More important, it also permits angular movement between blocks 46 and 52. This permits locating lens 38 in any desired position, depending on the nature of the cavity to be formed. Thus, a chart of precise settings can be developed for an array of different size and shape cavities to be cut for production of multifocal plastic lenses.

Figure 4:
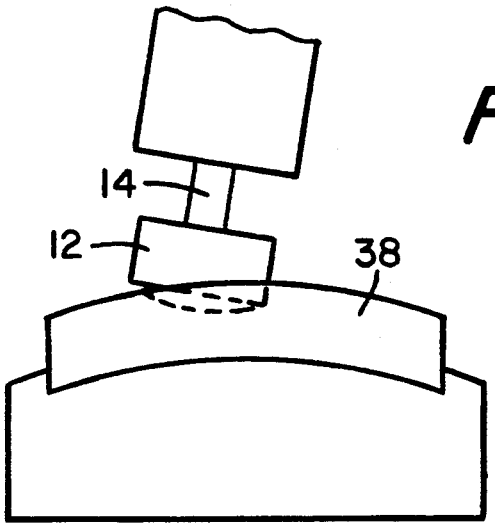
FIG. 4 is a schematic view illustrating the cavity forming action of FIG. 2.

FIG. 4 is a schematic view illustrating the cavity-forming action. Abrading tool 12 is shown midway through the arc that it traverses as it is moved by the assembly described with reference to FIG. 2. The plastic debris generated by the abrading action may be washed away by playing streams of coolant on the lens during the operation.

Figure 5:
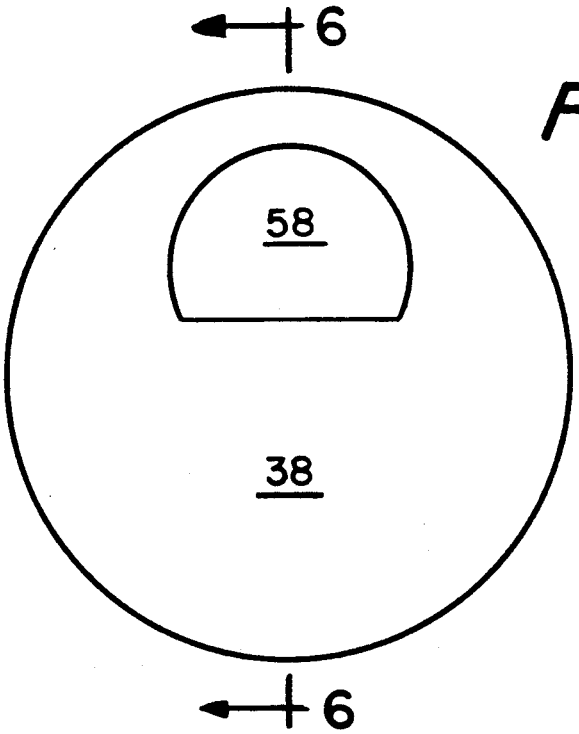
FIG. 5 is a top plan view of a lens having a cavity formed in accordance with the invention.
Figure 6:
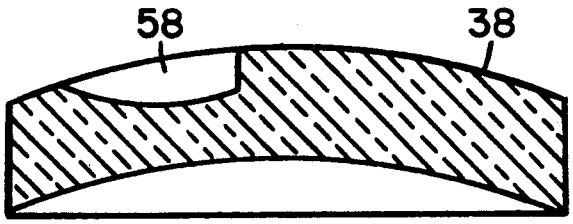
FIG. 6 is a cross-section view along line 6—6 of FIG. 5.

FIG. 5 shows a top view of lens blank 38 with a cavity 58 formed in its upper surface in the manner just described. FIG. 6 is a cross-section view along line 6—6 on FIG. 5. Cavity 58, as shown in FIGS. 5 and 6, is designed to form a segment in lens 38 known as a D-segment. The segment may be formed by filling cavity 58 with the precursor monomer of a high index polymer and curing the monomer in place. This is described in detail in copening application Ser. No. 07/682,479 mentioned earlier.

It will be appreciated that a special, dual bifocal lens, such as used by people who do overhead work, might also be produced. Such a lens has a bifocal segment in each of the top and bottom halves of the major lens blank. For such a bifocal lens, lens blank 38 might be turned 180° in its carrier and a cavity, corresponding to cavity 58, formed in the top half of the blank.

Figure 7:
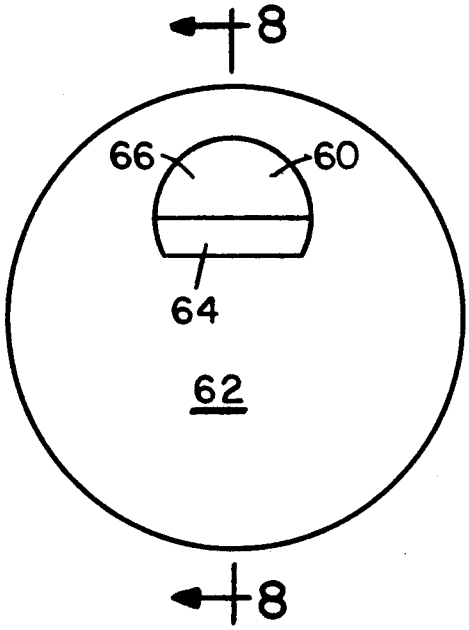
FIG. 7 is a top plane view of a lens having an alternative type of cavity formed in accordance with the invention and designed for a trifocal lens.
Figure 8:
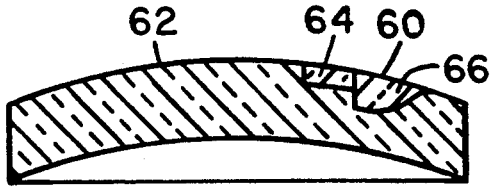
FIG. 8 is a cross-section view of the lens of FIG. 7 taken along line 8—8 in FIG. 7.

FIG. 7 is a top plan view of lens blank 38 with a cavity 60 formed in its upper surface 62 for production of a trifocal lens. Cavity 60 is a two-tier cavity having surfaces 64 and 66 which have different radii of curvature. Cavity 60 may then be filled with a precursor monomer for a high refractive index polymer. The monomer is then cured to form a trifocal segment. FIG. 8 is a cross-section view along line 8—8 in FIG. 7.

Cavity 60 will be formed in a two step operation. A first pass of abrading tool 12 forms surface 64. The relationship of lens blank 38 to tool 12 is then adjusted to provide a cut having a different radius of curvature to form surface 66.

Figure 9:
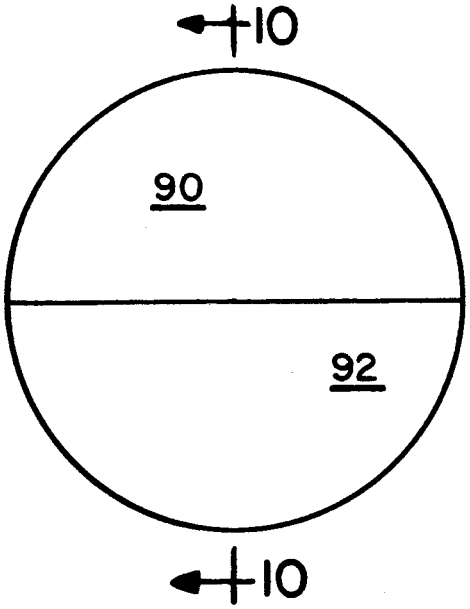
FIG. 9 is a top plan view of a lens having a further alternative type of cavity formed in accordance with the invention, and designed for use as an executive lens.
Figure 10:
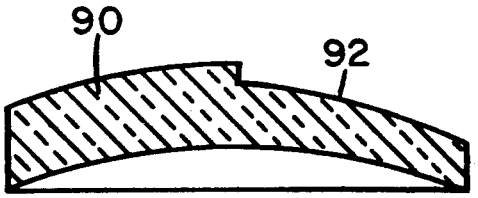
FIG. 10 is a cross-section view taken along line 10—10 in FIG. 9.

It is also possible to machine lens blank 38 to provide other multifocal lens styles, for example, the style commonly known as the executive lens. FIG. 9 is to plan view showing such a lens 90 with the near vision correction 92 extending across the entire lower portion of the lens. FIG. 10 is a cross-section view taken along line 10—10 of FIG. 9 showing the corrective surface 92 formed by the abrading action.

It will be appreciated that the executive type lens shown in FIGS. 9 and 10 provides an additive correction when used as shown. In that case, surface 92 provides near vision correction.

If lens 90 is to be used with a glass cap to form a glass-plastic, laminated lens, as described in the companion application, the cavity that provides surface 92 must be filled to form a continuous sealing surface. When the cavity is filled with a monomer that is cured to a high index polymer, the result is a subtractive effect. Consequently, the corrective effect changes so that the filled portion provides far vision correction. In use then, the lens is rotated 180° for mounting in a frame.

We claim:

1. A milling machine for forming a cavity in a rigid organic plastic body comprising an abrading tool mounted on a holder, a first means for applying a rotary motion to the tool, and a second means for swinging the tool along a limited arc through the plastic body, the second means comprising an air spindle, a cable subject to a constant force for applying rotary motion to the air spindle, and a motion translating means that is mounted on the air spindle and is operatively associated with the tool holder, whereby the rotary motion of the air spindle is translated into an arcuate motion of the tool holder.

2. A milling machine in accordance with claim 1 wherein the abrading tool is tipped with a hard grinding material.

3. A milling machine in accordance with claim 1 wherein the holder is a motor driven air spindle.

4. A milling machine in accordance with claim 1 wherein the constant force is resisted by an opposing force of lesser load acting on the cable end opposite to that upon which the moving force is exerted.

5. A milling machine in accordance with claim 1 further comprising a carrier for a rigid, organic plastic lens in a fixed position such that the arc through which the abrading tool moves passes through a portion of the lens.

6. A milling machine in accordance with claim 1 wherein the carrier is adjustably mounted, whereby the lens position can be set to provide predetermined radii of curvature in the cavity formed by the abrading tool.

7. A milling machine in accordance with claim 1 which further comprises a carrier in which an organic plastic, ophthalmic lens is mounted.

* * * * *

UNITED STATES PATENT AND TRADEMARK OFFICE

CERTIFICATE OF CORRECTION

PATENT NO. : 5,148,632

DATED : September 22, 1992

INVENTOR(S) : Adler et al.

It is certified that error appears in the above-identified patent and that said Letters Patent is hereby corrected as shown below:

Column 1, line 56, change "lens" to --index--.

Column 3, line 6, change "plane" to --plan--.

Column 3, line 55, change "now" to --not--.

Column 4, line 50, change "copening" to --copending--.

Column 5, line 6, change "to" to --top--.

Signed and Sealed this

Twenty-first Day of September, 1993

Bruce Lehman

*Attest:*

BRUCE LEHMAN

*Attesting Officer*

*Commissioner of Patents and Trademarks*